US009257112B2

(12) United States Patent
Mills et al.

(10) Patent No.: US 9,257,112 B2
(45) Date of Patent: Feb. 9, 2016

(54) SINGLE COIL PARALLEL TAPPED MAGNETIC PICKUP

(71) Applicant: Gibson Guitar Corp., Nashville, TN (US)

(72) Inventors: Stephen Eric Mills, Granger, IN (US); Francis Johns, Hermitage, TN (US)

(73) Assignee: Gibson Brands, Inc., Nashville, TN (US)

( * ) Notice: Subject to any disclaimer, the term of this patent is extended or adjusted under 35 U.S.C. 154(b) by 0 days.

(21) Appl. No.: 13/847,367

(22) Filed: Mar. 19, 2013

(65) Prior Publication Data

US 2013/0239788 A1 Sep. 19, 2013

Related U.S. Application Data

(60) Provisional application No. 61/612,822, filed on Mar. 19, 2012.

(51) Int. Cl.
*G10H 3/00* (2006.01)
*G10H 3/18* (2006.01)

(52) U.S. Cl.
CPC ..... *G10H 3/181* (2013.01); *G10H 2220/505* (2013.01)

(58) Field of Classification Search
CPC ..... G10H 3/181; G10H 2220/511; G10H 2220/505; G10H 2220/515
USPC ..... 84/726–728
See application file for complete search history.

(56) References Cited

U.S. PATENT DOCUMENTS

| | | | | |
|---|---|---|---|---|
| 4,854,210 | A * | 8/1989 | Palazzolo | 84/726 |
| 6,103,966 | A * | 8/2000 | Kinman | 84/728 |
| 6,846,981 | B2 * | 1/2005 | Devers | 84/728 |
| 7,227,076 | B2 * | 6/2007 | Stich | 84/726 |
| 8,319,088 | B1 * | 11/2012 | Harari | 84/727 |
| 2002/0020281 | A1 * | 2/2002 | Devers | 84/728 |
| 2002/0073830 | A1 * | 6/2002 | Petherick | 84/726 |

* cited by examiner

*Primary Examiner* — Jeffrey Donels
(74) *Attorney, Agent, or Firm* — Bates & Bates, LLC

(57) ABSTRACT

A parallel tapped magnetic pickup for an electrical stringed musical instrument is provided. The parallel tapped magnetic pickup comprises a coil formed with at least two parallel connected wound wires. A guitar in combination with the parallel tapped pickup is additionally provided.

20 Claims, 4 Drawing Sheets

SINGLE COIL PARALLEL TAPPED MAGNETIC PICKUP

CROSS-REFERENCE TO RELATED APPLICATION

This Application claims priority to U.S. Provisional Patent Application Ser. No. 61/612,822, filed Mar. 19, 2012, which application is hereby incorporated by reference in its entirety.

TECHNICAL FIELD

The field of the disclosure relates generally to the construction of transducers for converting the vibration of the strings of electrical musical instruments into a measurable voltage. More particularly, the disclosure relates to the construction of electromagnetic single coil parallel tapped pickups.

BACKGROUND

Electromagnetic pickup devices are used in conjunction with stringed musical instruments such as electric guitars and basses to convert the vibrations resulting from the movement or "picking" of the strings into electrical signals, for subsequent transmission to amplification devices to produce a desired sound. The pickup is generally positioned under the strings of the instrument on the base surface and the signal transmitted by an electromagnetic pickup is dependent upon the motions of each string.

The most essential components of a pickup are a permanent magnet and a coil of wire. The magnet generates a magnetic field that passes through the pickup coil and also extends into a space occupied by at least one string of the instrument. Vibration of the string changes the reluctance of the magnetic path and creates disturbances in the magnetic field proportional to the string vibration. The changing magnetic field in the pickup coil in turn induces an electrical signal in the coil. From the output of the pickup, a circuit connection is made to an amplifier.

There are several types of pickups with varying coil configurations known in the art. One type of electromagnetic pickup device is a single coil pickup. In a single coil pickup, a single coil portion has a plurality of magnetic pole pieces, with each pole piece associated with a string of the instrument. The pole pieces lie in a place spaced from the common plane of the strings, with each string disposed in a play extending through a space between two adjacent pole pieces, so that a given string at rest is located above and between two adjacent pole pieces.

SUMMARY

In one aspect, the present disclosure is directed toward a single coil pickup having a single coil form with an external connection to the beginning wire and the electrical end of the wire. At least one tapped connection is provided at a certain point between the beginning and at the electrical end of the wire.

In addition to the coil, the pickup comprises a magnet and potentially a bobbin and pole pieces. The coil may be directly wound around the permanent magnet or pole pieces or alternatively may be wound around the bobbin and then the bobbin is placed around the pole pieces.

Consistent with yet a further aspect of the disclosure, a guitar with a disclosed pickup is claimed.

A method of using the pickups of the current disclosure is also contemplated. In this method, user may switch between sections of the pickup to achieve various tones. The disclosure allows for utilization of all of the windings of the coil by making a parallel connection between more than a single section of the coil.

DETAILED DESCRIPTION

Before describing the exemplary embodiments in detail, it is to be understood that the embodiments are not limited to particular apparatuses or methods, as the apparatuses and methods can, of course, vary. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which an embodiment pertains. Many methods and materials similar, modified, or equivalent to those described herein can be used in the practice of the current embodiments without undue experimentation.

As used in this specification and the appended claims, the singular forms "a", "an" and "the" can include plural referents unless the content clearly indicates otherwise. Thus, for example, reference to "a component" can include a combination of two or more components.

Figure 1:
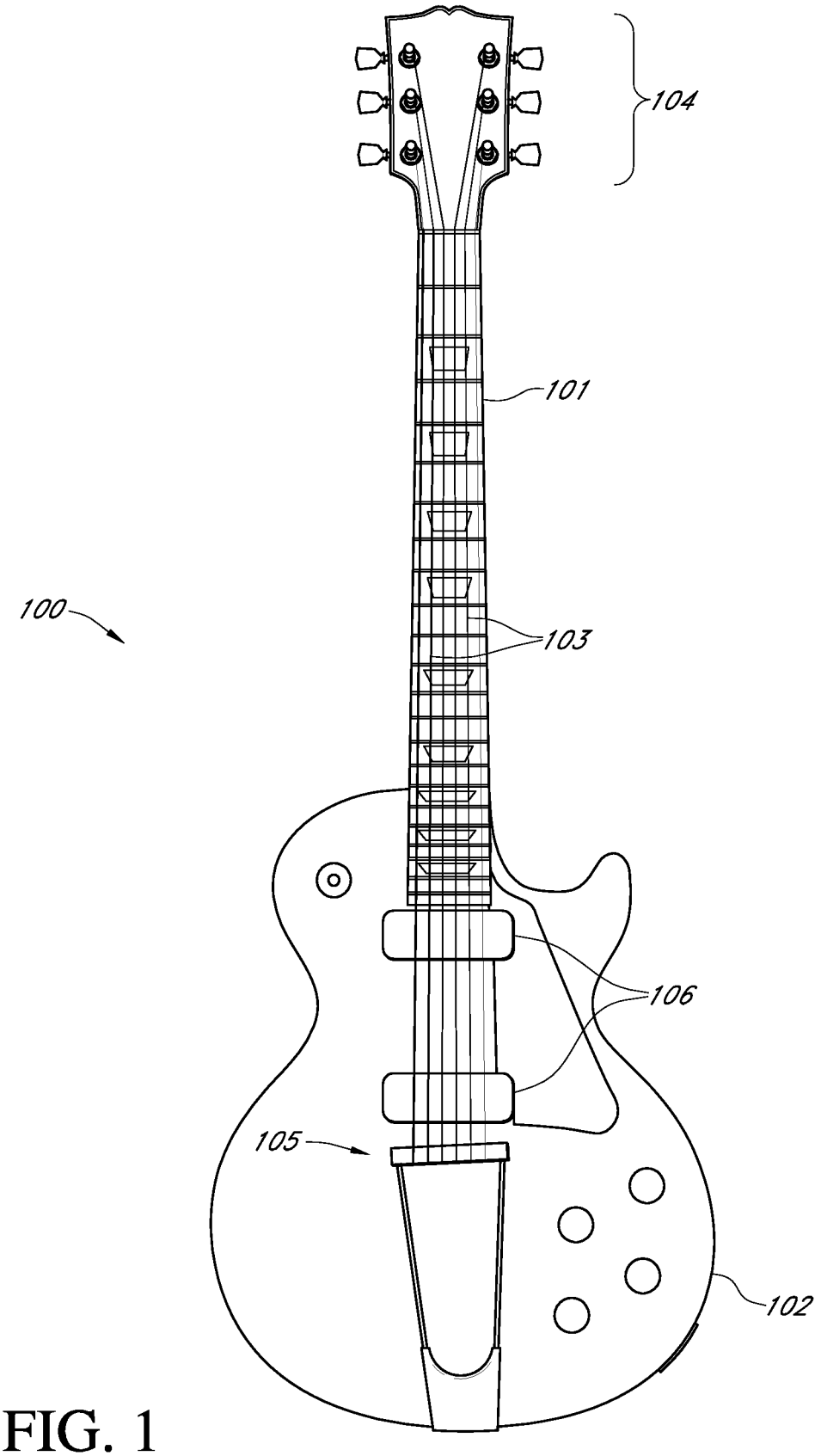
FIG. 1 depicts a front elevational view of a stringed electrical musical instrument with the pickups of the present disclosure.

Exemplary embodiments of the single coil parallel tapped pickup will now be explained with reference to the figures. This description is provided in order to assist in the understanding of the invention and is not intended to limit the scope of the invention to the embodiments shown in the figures or described below. As used herein, a "coil" is a wound spiral of two or more turns of wire used to conduct current. FIG. 1 demonstrates a stringed electrical musical instrument. In the embodiment of FIG. 1, the stringed instrument is a six stringed guitar. However, the components and advantages currently disclosed are applicable to other types of stringed instruments, such as bass guitars, ukuleles, mandolins, violins or guitars with a different number of strings. Referring now to FIG. 1, guitar 100 comprises a neck 101 and a main body 102. The guitar 100 includes guitar strings 103 that are secured on one end to a tuning head 104 and on the other end to a bridge 105 in a manner well known in the art.

FIG. 1 further demonstrates a pair of pickup units 106 arrayed beneath the strings 103 and secured onto the face of the main body 102 of the guitar in a conventional manner. In certain aspects, pickup units 106 are fitted into apertures in main body 102. In order for the disclosed pickups to function as desired, strings 103 must be made from a magnetizable material such that pickup can electromagnetically interact with strings 103. The pickups may be placed in various positions on the main body 102 of the guitar. Pickups placed near bridge 105 are generally called bridge pickups, whereas pickups placed adjacent to neck 101 are called neck pickups. The embodiments disclosed may be use as both bridge and neck pickups. Furthermore, more than one pickup may be used with a stringed electrical musical instrument. In the event more than one pickup is used, the pickups may be connected via switches such that one, or more than one, may transmit at a time. The pickups disclosed may also be used with other types of pickups such as traditional single coil or traditional humbucking pickups.

Figure 2:
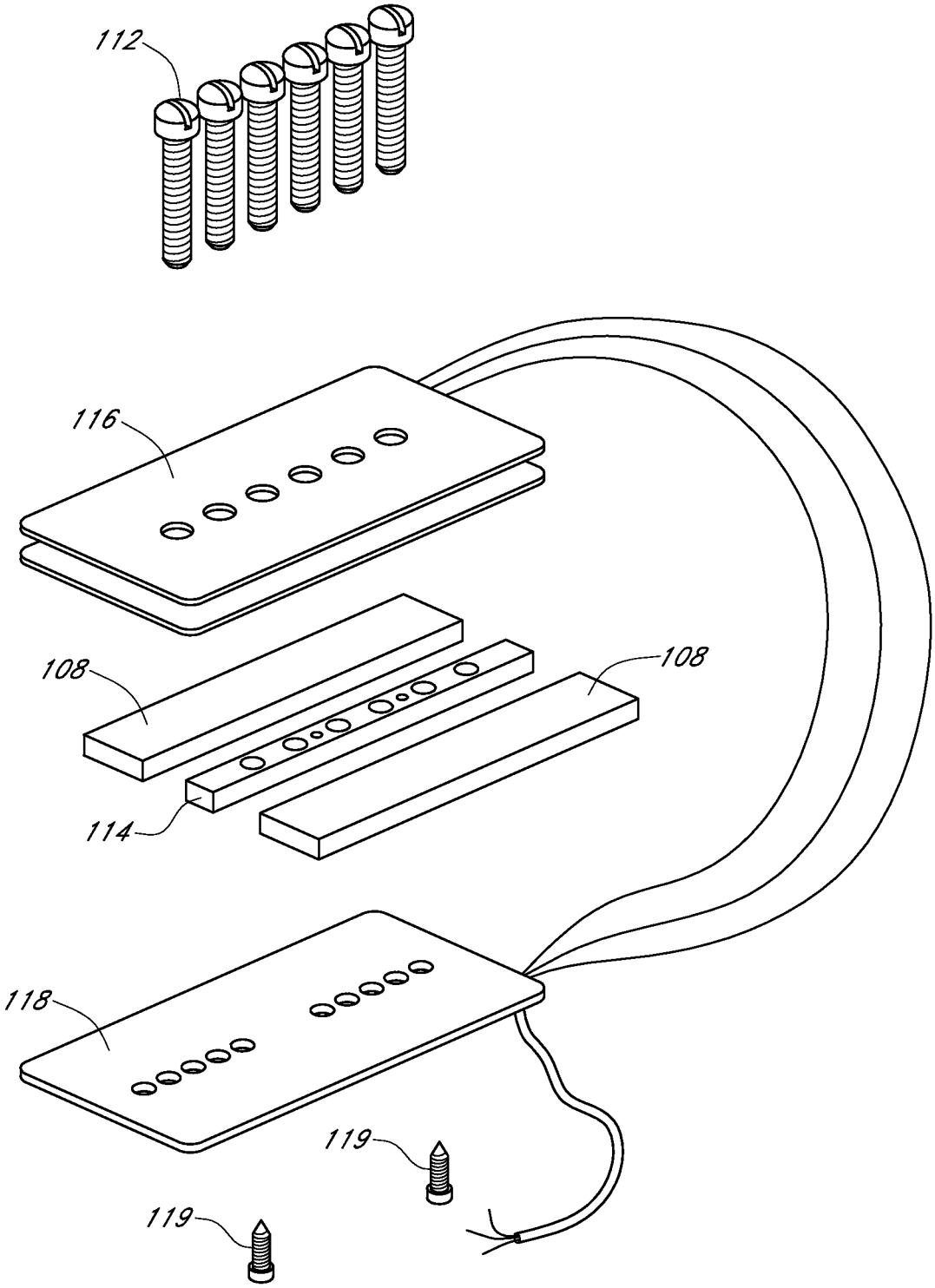
FIG. 2 illustrates the common pieces of a single coil pickup.

Pickup units 106 comprise at least one permanent magnet 108 and a coil 110, as better demonstrated in FIG. 2. Embodiment pickup units 106 may also include pole pieces 112 such as those demonstrated in FIG. 2. In the pickup unit illustrated in FIG. 2, the pickup unit additionally comprises a pole shoe 114, bobbin (or coil form) 116, at least one base screw 119, and a base plate 118.

The magnets used in exemplary embodiments of the pickup units 106 are not meant to be limiting. Several different types of permanent magnets, such as Alnico, ceramic, and samarium-cobalt are contemplated. Depending on the embodiment, the number and shape of the magnets may also vary. In one embodiment, the pickup unit 106 has two permanent magnets 108. If these are Alnico permanent magnets, they may be either cylindrical or bar-shaped. In embodiments which use Alnico magnets, the grade of the magnet may be Alnico 5, Alnico 2, Alnico 3, Alnico 4, Alnico 7 or Alnico 8. In one embodiment, a single bar-shaped Alnico 5 magnet is used.

Examples of specific magnet sizes and shapes that may be used in embodiments of the invention include, but are not limited to, a ceramic 5, ceramic 8, an Alnico 2, or an Alnico 5magnet that is rectangular with a length of about 2 inches, a width of about 0.5 inch and a depth of about 0.12 inch.

Although pickup units 106 do not need to use pole pieces 112 to function (unless the pole pieces are the required permanent magnet), many embodiments will have pole pieces 112. The particular pole piece 112 is not limiting and any magnetizable material in contact with the permanent magnet 108 to produce an electro-magnetic field is contemplated. In the embodiment demonstrated in FIG. 2, the pole pieces 112 are adjustable threaded steel poles. Nevertheless, certain embodiments will have non-adjustable pole pieces 112. In yet other embodiments, there may be both adjustable and non-adjustable pole pieces 112. In many embodiments, the pole pieces 112 are either steel, iron, or Alnico magnets. In addition to embodiments having a pole piece 112 for each string, pole pieces 112 may also be shaped as a blade or as a rail.

Coil 110 is constructed by winding wire around pole pieces 112. In the embodiment of FIG. 2, coil 110 is constructed by winding a wire 120 around bobbin 116 and then connecting at least one additional wire 122 in a parallel connection between the beginning and end of wire 120. The bobbin containing these wires is then placed around pole pieces 112. In some embodiments the bobbin has a web containing bores adapted for containing the pole pieces. The skilled artisan may directly wind wire around the pole pieces 112 in some embodiments. Bobbin 116 may be made of any non-conductive material. In some embodiments, bobbin 116 is made from plastic such as nylon. In other embodiments, bobbin 116 is made from wood. In many embodiments, it is preferable to make bobbin 116 from material that is an electrical insulator.

As is well understood by the skilled artisan, the shape of the coil form may vary depending on the type of pickup sound being sought. In many embodiments, the coil form will be a generally rectangle shape with soft corners, such as the coil form in FIG. 3.

Figure 3:
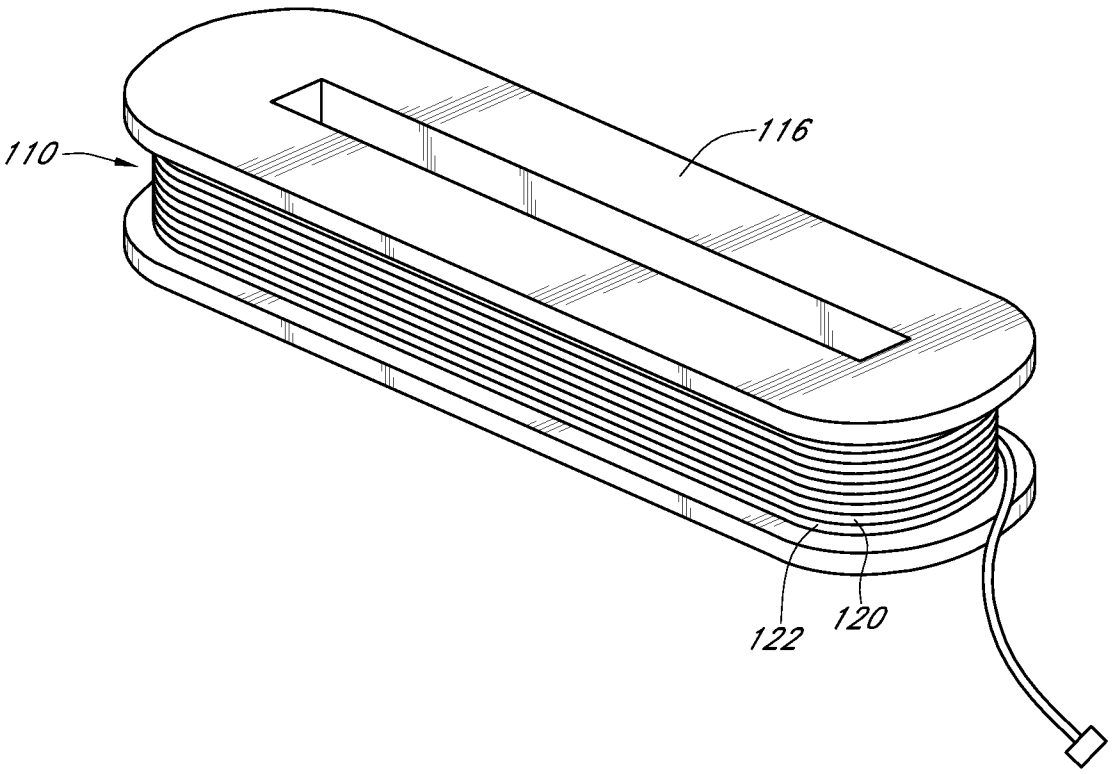
FIG. 3 demonstrates a close-up view of the parallel tapped winding of the coil.

FIG. 3 demonstrates the detail of the winding of each coil 110. In embodiments of the invention, a single coil parallel tapped magnetic pickup is created by winding wire 120 around the bobbin. Wire 122 is then connected to wire 120 in a parallel configuration, i.e. tapped between the beginning and end of wire 120. Additional wires may also be connected to wire 120 between the beginning of wire 120 and parallel connection of wire 122 or the parallel connection of wire 122 and end of wire 120. The number of connected, i.e. tapped, wires is not meant to be limiting and can be determined by the skilled artisan to provide the desired pickup tone. The placement of the tapped wires is also not limiting and parallel tapped wires, such as wire 122 may be placed in any position along wire 120 in order to produce the desired tone.

The first end 124 of wire 120 connects to coil output 125, which can be a signal ground. A beginning 123 of tapped wire 122 is connected to wire 120. Additional wires may also be connected to wire 120 at the same position as tapped wire 122. The electrical end of wire 120 is the tapped connection 123, which is a signal output commonly connected to a jack. This tapped connection 123 is the beginning of wire 122 whereas the end 126 of wire 122 is connected to an output switch 127 that connects to ground when a parallel connection is desired.

The wire gauges used for coil 110 can be of any predetermined gauge. As is well understood by the skilled artisan, the desired tonality and output of the pickup device may be achieved by using a variety of gauges. For example, some embodiments use American Wire Gauge (AWG) 38 or AWG 40 or AWG 42 or AWG 43 or AWG 44. In an exemplary embodiment AWG 42 is used for both wire 120 and wire 122. However, the gauge of wires 120 and 122 do not need to be the same.

Generally, wires 120 and 122 are insulated copper wire. The copper wire may be enameled. Different types of insulation are known in the art and are not limiting when used with exemplary embodiments. For example, in other embodiments wires 120 and 122 may be insulated with polysol or polyurethane.

Various numbers of turns of wires 120 and 122 can be used in embodiments of the invention. As is well understood in the art, the number of turns of wire on a particular coil 110 contributes to a particular pickup sound. Therefore, the turns of wire 120 and wire 122 can be varied depending on the type of sound desired. In some embodiments, wire 120 and wire 122 will have an equal number of turns. In other embodiments, wire 120 and wire 122 will have a different number of turns. In one embodiment, coil 110 consists of about 4000 turns of both wire 120 and wire 122. In other embodiments, coil 110 consists of about 5000 turns or about 7500 turns of wire 120 and wire 122. In yet another embodiment, coil 110 consists of about 10000 turns of wire 120 and wire 122. In still further embodiments, coil 110 consists of less than about 2500 turns of wire 120 and wire 122, about 2500 turns of wire 120 and wire 122, between about 2500 turns to about 3500 turns of wire 120 and wire 122, or between about 3500 turns to about 4000 turns of wire 120 and wire 122.

Figure 4:
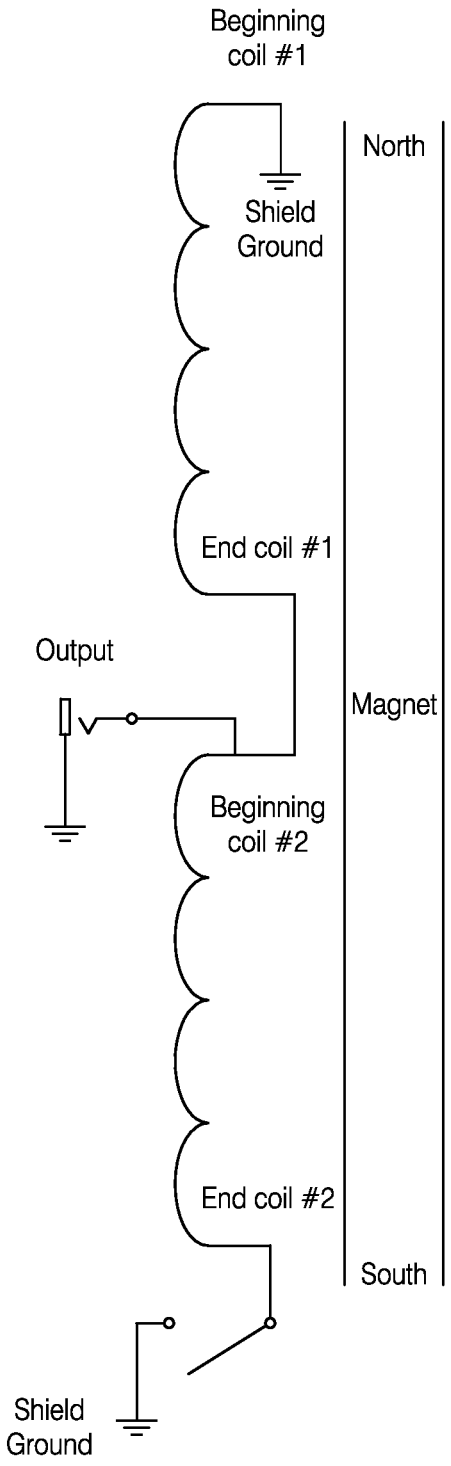
FIG. 4 is a schematic diagram of the circuitry of the parallel tapped coil wiring.

While a particular polarity is shown for magnet 108 in FIG. 4, the polarity may be reversed without affecting the operation of the pickup. As is well known in the art, when two single coils are used on the same musical instrument, the tone is affected when magnet 108 has different polarity for each coil. Thus, if more than one single coil magnet is used on a musical instrument, each single coil may have either the same polarity of magnet 108 or reverse polarity of magnet 108.

Any aspect or design described herein as "exemplary" is not necessarily to be construed as preferred or advantageous over other aspects or designs. Exemplary embodiments may be implemented as a method, apparatus, or article of manufacture. The word "exemplary" is used herein to mean serving as an example, instance, or illustration.

From the above discussion, one skilled in the art can ascertain the essential characteristics of the invention, and without departing from the spirit and scope thereof, can make various changes and modifications of the embodiments to adapt to various uses and conditions. Thus, various modifications of the embodiments, in addition to those shown and described herein, will be apparent to those skilled in the art from the foregoing description. Such modifications are also intended to fall within the scope of the appended claims.

What is claimed is:

1. A pickup for a stringed electrical musical instrument comprising:

a permanent magnet with a single polarity, wherein the permanent magnet is uniaxial; and a single coil form associated with the magnet, wherein the single coil form is concentric wound with at least two wires, further wherein a second wire of the at least two wires is connected with a first wire of the at least two wires in a parallel connection.

2. The pickup of claim 1 wherein the first wire has a first end connected with a ground and a second end connected with an output.

3. The pickup of claim 2 wherein the second wire has a first end connected with the output.

4. The pickup of claim 3 wherein the second wire has a second end connected with a switch.

5. The pickup of claim 1 further comprising:

at least one pole piece associated with the magnet, wherein the coil is placed around the at least one pole piece.

6. The pickup of claim 5, further comprising:

a bobbin, wherein the bobbin is placed around the at least one pole piece, further wherein the coil is wound around the bobbin.

7. The pickup of claim 6 wherein the bobbin is a generally rectangular shape.

8. The pickup of claim 1 wherein the permanent magnet is an Alnico magnet.

9. The pickup of claim 1 wherein the permanent magnet is a ceramic magnet.

10. The pickup of claim 1 wherein the at least two wires are wound about 4000 times.

11. The pickup of claim 1 wherein the at least two wires are insulated copper AWC 42.

12. A stringed electrical musical instrument comprising:

a guitar;

a pickup mounted on the guitar, wherein the pickup comprises a permanent magnet with a single polarity, wherein the permanent magnet is uniaxial; and a single coil form associated with the magnet, wherein the single coil form is concentric wound with at least two wires, further wherein a second wire of the at least two wires is connected with a first wire of the at least two wires in a parallel connection.

13. The pickup of claim 12 wherein the first wire has a first end connected with a ground and a second end connected with an output.

14. The pickup of claim 13 wherein the second wire has a first end connected with the output.

15. The pickup of claim 13 wherein the second wire has a second end connected with a ground.

16. The stringed electrical musical instrument of claim 13 further comprising:

at least one pole piece associated with the magnet, wherein the coil is placed around the at least one pole piece.

17. The stringed electrical musical instrument of claim 16, further comprising:

a bobbin, wherein the bobbin is placed around the at least one pole piece, further wherein the coil is wound around the bobbin.

18. The stringed electrical musical instrument of claim 17 wherein the bobbin is a generally rectangular shape.

19. The stringed electrical musical instrument of claim 13 wherein the permanent magnet is an Alnico magnet.

20. A stringed electrical musical instrument comprising:

a guitar; and a pickup mounted on the guitar, wherein the pickup comprises a permanent magnet with a single polarity, wherein the permanent magnet is uniaxial, further wherein the permanent magnet is an Alnico magnet;

a single coil form associated with the magnet, wherein the single coil form sections are concentric wound with at least two wires, further wherein the at least two wires are wound in a tapped parallel manner, wherein the first wire has a first end connected with a ground and a second end connected with an output, further wherein the second wire has a first end connected with the output and a second end connected to a switch;

at least one pole piece associated with the magnet, wherein the coil is placed around the at least one pole piece; and a bobbin, wherein the bobbin is placed around the at least one pole piece, further wherein the coil is wound around the bobbin, wherein the bobbin is a generally rectangular shape.

* * * * *